United States Patent [19]

Stone

[11] 4,041,718

[45] Aug. 16, 1977

[54] SEALING DEVICES

[75] Inventor: William Bundy Stone, Houston, Tex.

[73] Assignee: Deep Sea Grouting Packers, Inc., Gretna, La.

[21] Appl. No.: 670,064

[22] Filed: Mar. 24, 1976

Related U.S. Application Data

[63] Continuation-in-part of Ser. No. 523,803, Nov. 14, 1974, Pat. No. 3,967,456.

[30] Foreign Application Priority Data

Mar. 24, 1975 United Kingdom ..... 12209/75

[51] Int. Cl.[2] ..... E02D 5/52; F16J 15/40

[52] U.S. Cl. ..... 61/86; 61/98; 61/99; 277/34; 285/18; 285/97

[58] Field of Search ..... 61/85, 53, 100, 98, 61/99, 102; 285/18; 277/34, 34.3

[56] References Cited

U.S. PATENT DOCUMENTS

| | | | |
|---|---|---|---|
| 2,864,258 | 12/1958 | Klingler | 285/97 X |
| 3,564,856 | 2/1971 | Blount et al. | 61/53.5 |
| 3,782,738 | 1/1974 | Oshira et al. | 285/97 X |
| 3,839,872 | 10/1974 | Loire | 61/58 X |

*Primary Examiner*—Jacob Shapiro

*Attorney, Agent, or Firm*—Birch, Stewart, Kolasch and Birch

[57] ABSTRACT

In a sealing device for sealing the gap between a tubular leg or a tubular piling can and a pile passing therethrough for supporting a permanent platform at sea, which sealing device comprises a first part in the form of an annular sealing element and a second part, through which the pile can pass, in the form of an annular protective guard for the sealing element, both parts being coaxial with the leg or can, the guard, before a seal is made with the pile, lying between the sealing element and the pile, there being means provided which, in use, enable such relative movement in an axial direction between the guard and the sealing element, that the guard no longer protects the sealing element which is thus free to make sealing contact between the pile and the leg or can, the provision of a plurality of support members pivotally connected adjacent the sealing element, the support members lying between the sealing element and the guard before a seal is made with the pile such that, when relative axial movement takes place between the guard and the sealing element so that the guard no longer protects the sealing element, the support members are released and are free to pivot so as to contact the pile and support the sealing element against excessive deformation or rupture under pressure.

22 Claims, 9 Drawing Figures

SEALING DEVICES

The present invention relates to sealing devices suitable for sealing the gap between a tubular leg or a tubular piling can and a pile passing therethrough, for supporting permanent platforms at sea and the present application is a continuation-in-part of my application Ser. No. 523,803 of Nov. 14, 1974, now U.S. Pat. No. 3,967,456.

In the aforesaid application there is described and claimed a sealing device for sealing the gap between a tubular leg or a tubular piling can and a pile passing therethrough for supporting a permanent platform at sea, the sealing device comprising a first part in the form of an annular sealing element and a second part, through which the pile can pass, in the form of an annular protective guard for the sealing element, both parts being coaxial with the leg or can, the guard, before a seal is made with the pile, lying between the sealing element and the pile, there being means provided which, in use, enable such relative movement in an axial direction between the guard and the sealing element, that the guard no longer protects the sealing element which is thus free to make sealing contact between the pile and the leg or can.

In view of the high pressure at depth under water, it is thought there may be a possibility of the sealing element being excessively deformed or ruptured where it bridges the gap between the pile and the leg or can, so breaking the seal.

According to the present invention, there is provided a plurality of support members pivotally connected adjacent the sealing element, the support members lying between the sealing element and the guard before a seal is made with the pile such that, when relative axial movement takes place between the guard and the sealing element so that the guard no longer protects the sealing element, the support members are released and are free to pivot so as to contact the pile and support the sealing element against excessive deformation or rupture under pressure.

In order to strengthen the sealing element, an internal reinforcement of relatively stiff material, such as wire mesh, or a reinforcement as conventionally used in motor car tyres, can be provided therein.

The invention will now be described in more detail, by way of example, with reference to the accompanying drawings, in which.

Figure 9:
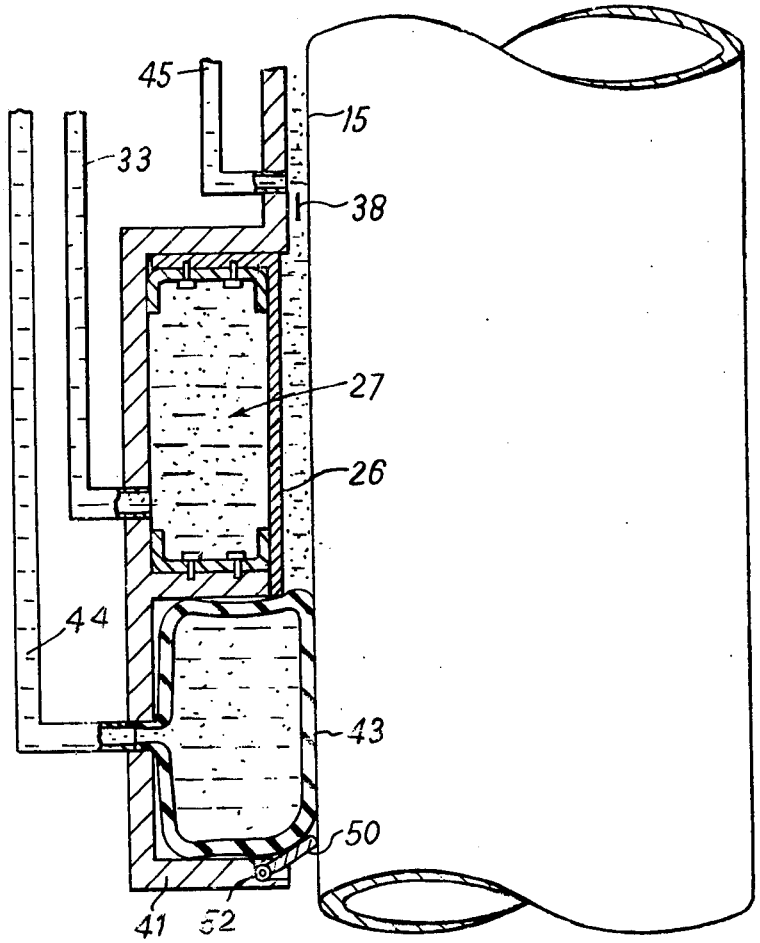
Figure 3:
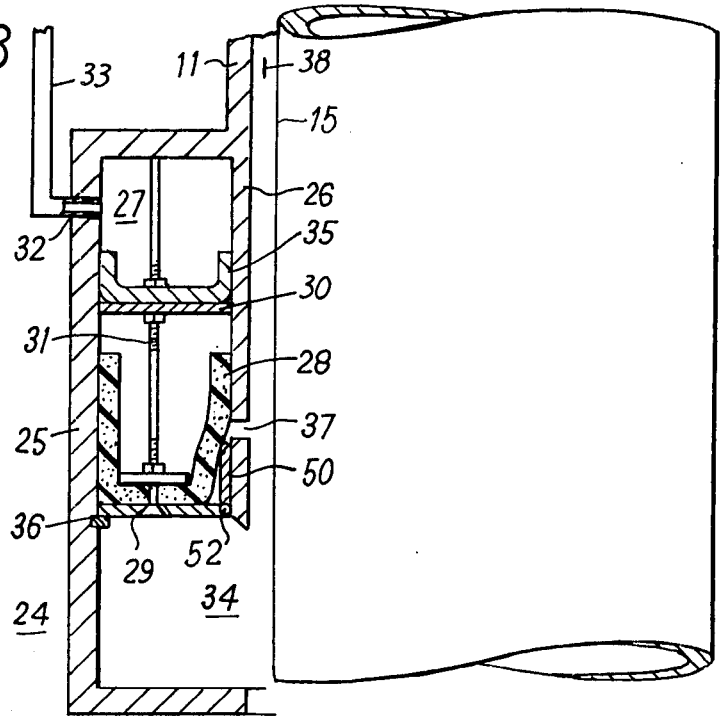
FIG. 3 shows a cross-sectional view to an enlarged scale of a sealing device of the type using a sealing element in the form of an annular trough, located at the lower extremity of a tubular leg of FIG. 1.
Figure 4:
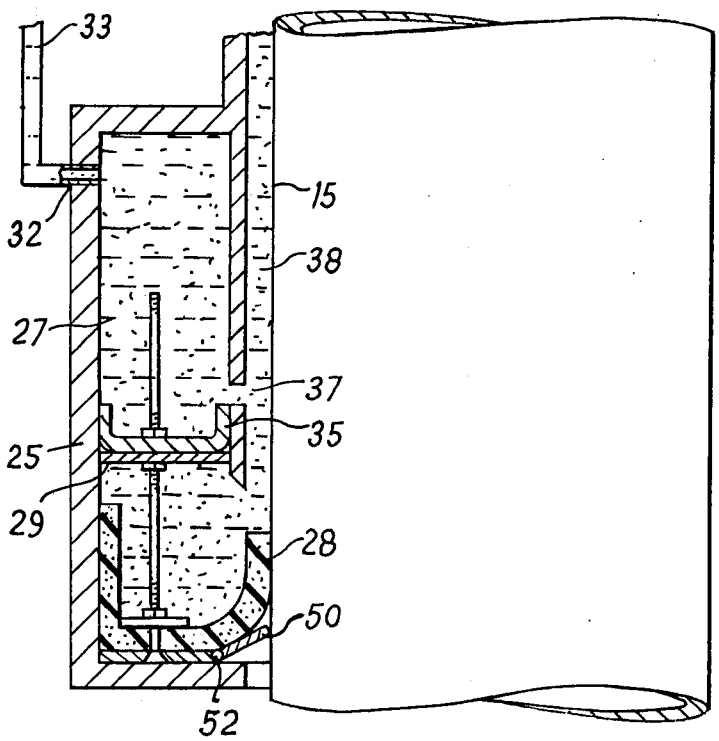
Figure 5:
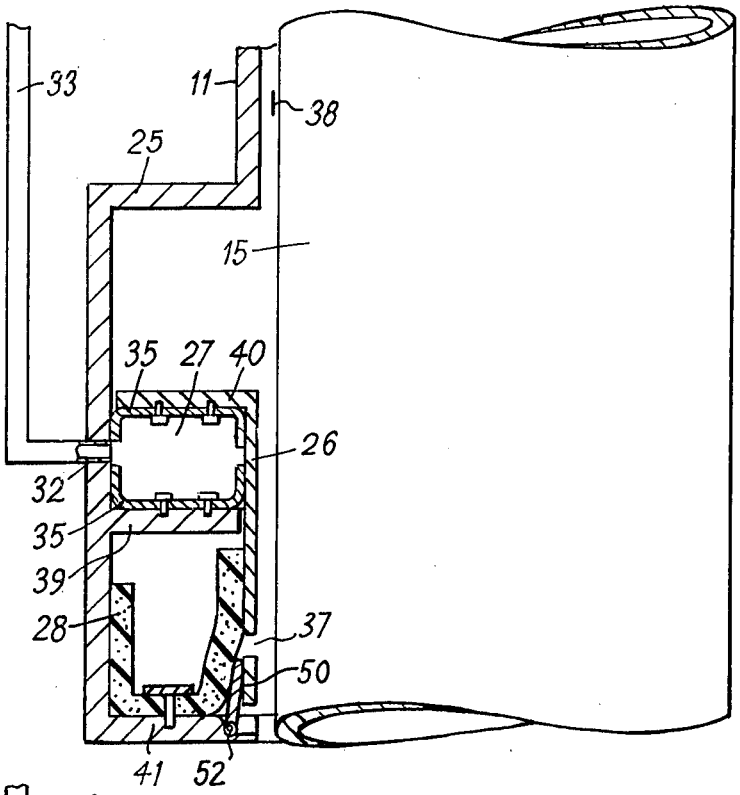
Figure 6:
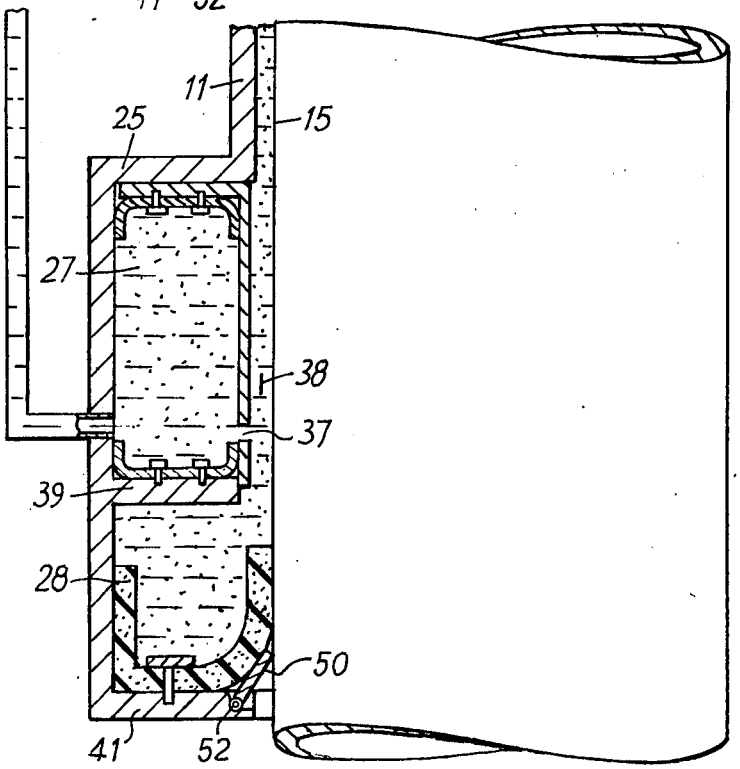
Figure 7:
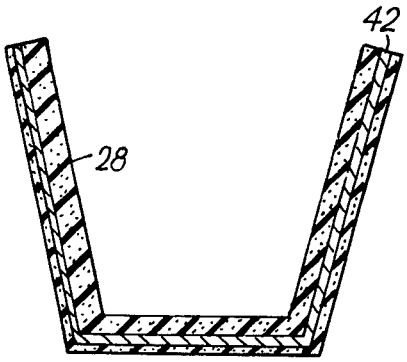
Figure 8:
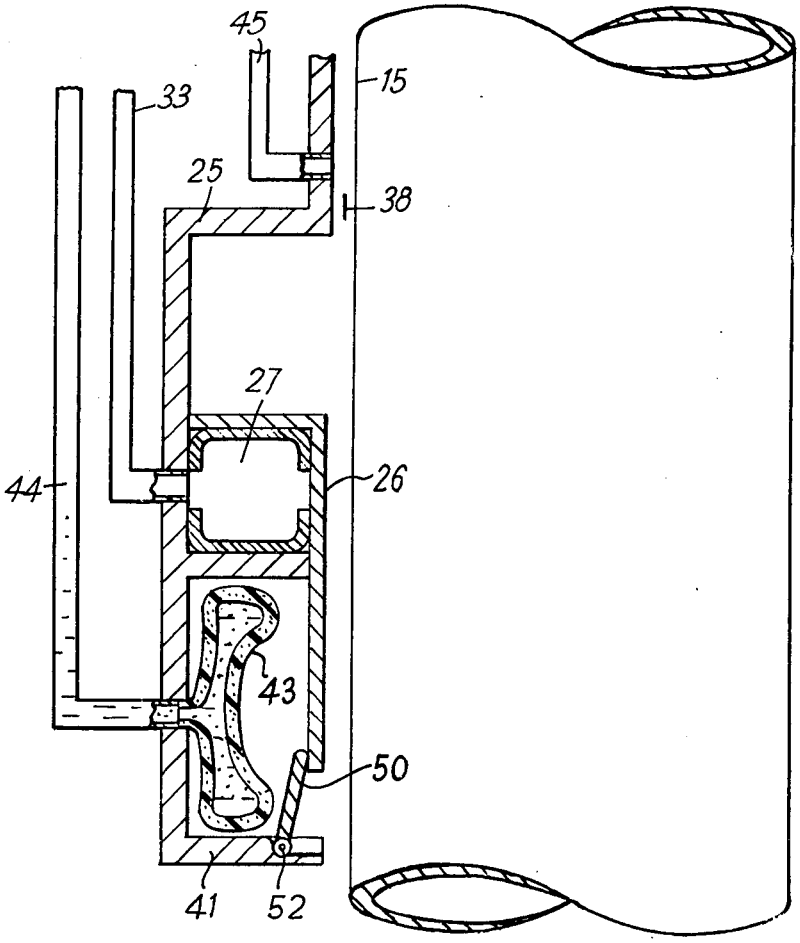

FIG. 4 corresponds to FIG. 3 after the sealing device has been activated to provide a seal;

FIGS. 5 and 6 show in corresponding inactivated and activated states an alternative arrangement of the sealing device of FIGS. 3 and 4;

FIG. 7 shows to an enlarged scale the sealing element of the sealing device of FIGS. 3 and 5;

FIG. 8 shows a cross-sectional view of a sealing device using an inflatable tube as the sealing element; and FIG. 9 corresponds to FIG. 8 after the sealing device has been activated to provide a seal.

Figure 1:
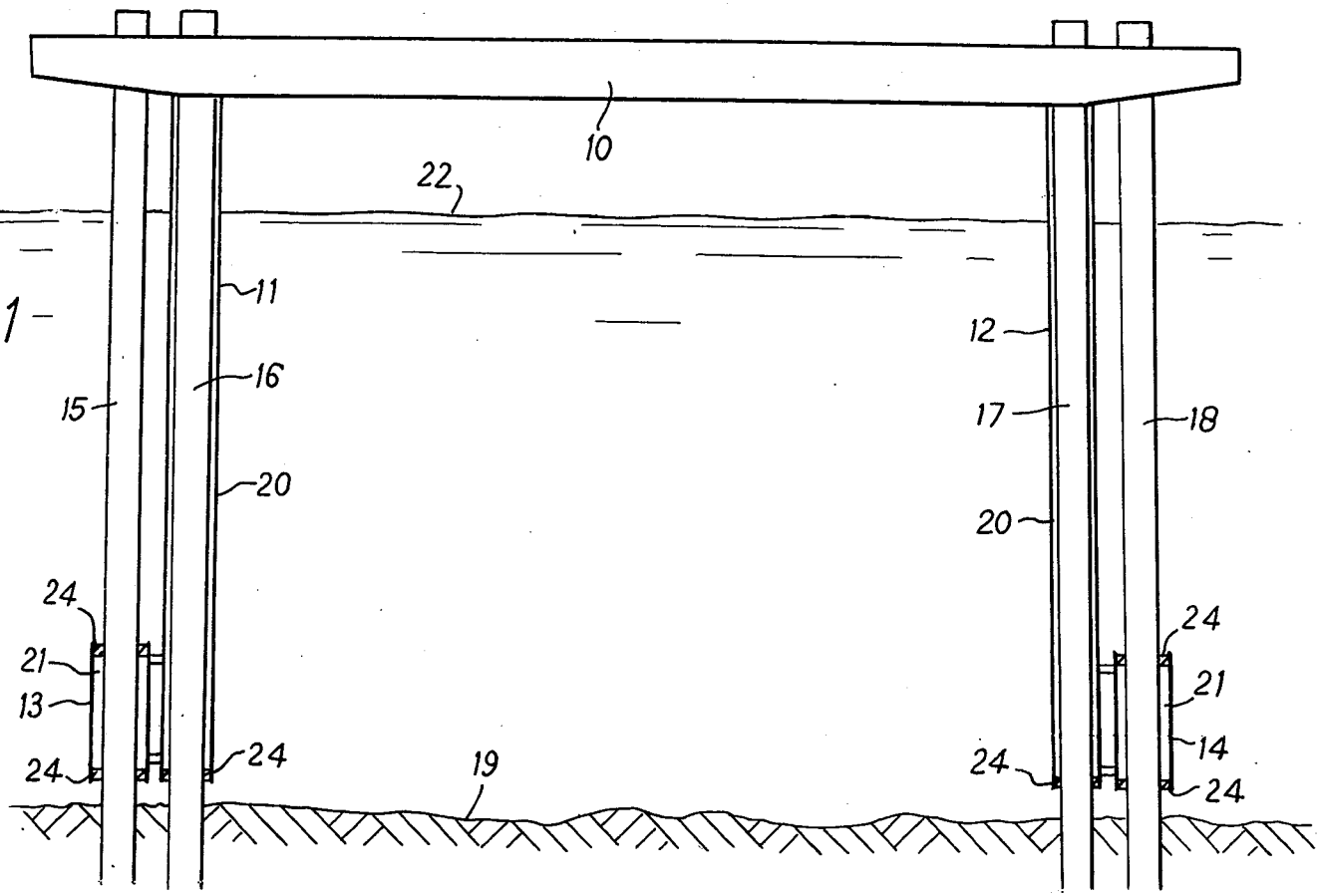
FIG. 1 shows schematically, and in elevation, part of a permanent platform at sea, used subsequent to drilling operations for oil or gas.

Referring to FIG. 1, a permanent platform 10 is supported on legs of which two are shown at 11 and 12. Attached to the lower ends of the legs are tubular piling cans 13 and 14. Piles 15, 16, 17 and 18 are driven through the piling cans and the legs into the sea bed 19 and a cement and water slurry is pumped into the spaced 20 and 21 between each pile and its surrounding leg or can. The platforms are substantial structures, for instance the distance between the platform 10 and seal level 22 can be one hundred feet or more, and the distance between sea level and the sea bed can be over 500 feet. A pipe meeting the leg or can just above the lower extremity thereof can be used to pump grouting cement from the platform into the space between the pile and its surrounding can or leg, displacing water from the space as it is filled thereby. Sealing devices 24 are provided at the upper and lower extremities of the piling cans and at the lower extremities of the legs, to prevent the grouting cement from spilling onto the sea bed.

Figure 2:
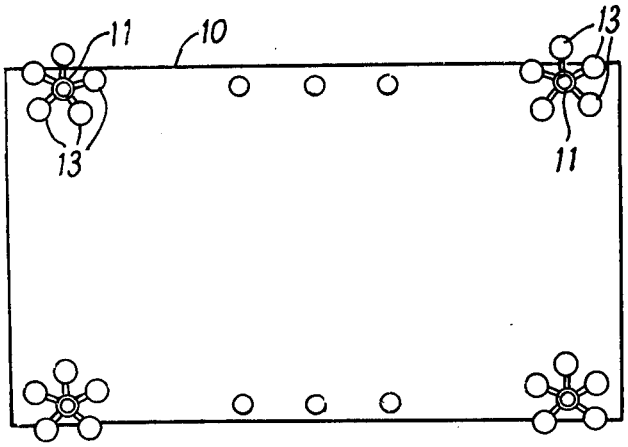
FIG. 2 shows schematically a plan view of the permanent platform of FIG. 1.

Referring to FIG. 2, which is a schematic plan view of the permanent platform 10, in practice several cans 13 are attached to the lower end of each leg 11, and piles are driven through each can into the sea bed so providing a strong anchorage for the platform.

Referring to FIG. 3, the sealing device 24 comprises an annular housing 25 joined to the lower extremity of a tubular leg 11. An annular protective guard 26 extends beyond the leg 11, and together with the housing 25 forms a pressure chamber 27. An annular resilient sealing element 28 is located in the chamber and is affixed at its base to an annular ledge 29. Support members, of which one is shown at 50, are pivotally connected by generally tangent pivots 52 to the ledge 29 near its inner edge. The support members are disposed between the guard 26 and the element 28, and are arranged close together in a circle. The ledge is slidable relative to the chamber and is attached to an annular piston 30 by means of connecting rods, one of which is shown at 31. The sealing element is manufactured in the form of an annular trough with its opposite walls diverging from the vertical, as shown in FIG. 7, and the diameter of its inner edge is arranged to be less than that of the pile with which it is to make sealing contact. Thus, the walls of the element, as shown in FIG. 3, are distorted substantially to a vertical position, the outer wall pressing against the housing 25 and the inner wall against the support members 50 and the guard 26. The support members 50 are pressed against the guard 26.

To achieve a seal between the leg and the pile, a suitable medium, such as water or a cement and water slurry, is pumped through a port 32 in the side of the housing into the pressure chamber 27 (see FIG. 4). The port is connected to the permanent platform by a pipe 33. The piston is thus forced axially outwardly moving, by means of the connecting rods 31, the ledge 29, the sealing element 28 and the support members 50 past the protective guard. As soon as the support members 50 are clear of the guard, the sealing element springs, due to the inbuilt resilience thereof, through the aperture 34, pivots the support members 50 and makes sealing contact with the pile 15. The support members 50 are pressed against the pile 15 by the element 28 and support it against excessive deformation or rupture under high pressure of grouting fluid, which would cause the seal to break. Only small gaps are left between the support members, as they are closely spaced, so that deformation of the sealing element into the gaps is very small, and does not break the seal. An annular skirt 35 is provided on the piston to aid the sealing contact between it and the pressure chamber.

To prevent the sealing element from premature movement, a shear pin 36 (FIG. 3) is provided at the outer side of the ledge 29. When the medium pumped into the pressure chamber exerts sufficient pressure, the shear pin shears and permits the sealing element to move axially outwards.

In accordance with a feature of the invention, circumferentially-spaced apertures 37 are provided around the lower end of the protective guard 26. After the sealing element 28 makes sealing contact with the pile located therethrough, the piston 30 reaches the end of its travel, and the apertures provide fluid communication between the pressure chamber and the annular space 38 between the pile and its surrounding leg (see FIG. 4). Thus only one pipe 33 from the permanent platform to the lower extremity of the tubular leg to which the housing 25 is attached is necessary, the grouting cement both activating the sealing device and filling the annular space. It will be appreciated that the circumferentially-spaced apertures 37 enable the grouting cement to pass into the annular space 38 at several points. Thus the annular space is filled evenly, once the chamber has freed the sealing element from the protective guard.

When the tubular legs and piling cans of permanent platforms are submerged, considerable pressure is exerted on the pipe 33 and the pressure chamber. Sea water can leak past the walls of the sealing element and also past the skirt 35 on the piston 30 to equalise the pressure within the chamber, and so fill the pipe 33. If this leakage should be insufficient, a port, having a one-way check valve, can be provided on the pipe 33 to allow sea water to fill it more quickly.

In the sealing device shown in FIGS. 3 and 4 relative movement between the sealing element and the protective guard is effected where the guard is fixed and the sealing element is moved. FIGS. 5 and 6 show a sealing device in which the sealing element is fixed and the guard is moved.

Referring to FIGS. 5 and 6, the annular pressure chamber 27 is formed by the housing 25, a fixed annular ledge 39 and the protective guard 26, there being an annular surface 40 similar in shape to the ledge 39 affixed to the upper end of the guard. The chamber is again shown on the axially inward side of the sealing element 28. The sealing element is affixed to an annular ledge 41 protruding radially inwardly from the lower end of the housing 25. Support members, of which one is shown at 50, are pivotally connected by generally tangent pivots 52 to the ledge 41 near its inner edge. The support members are disposed between the guard 26 and the element 28, and are arranged close together in a circle. The protective guard 26 is slidable, in this arrangement, relative to the housing 25 and is held centrally therein by virtue of the annular surface 40.

To operate the sealing device, water or a cement and water slurry is pumped, as before, through a port 32 into the pressure chamber 27. The chamber expands and, as it does so, it draws the guard 26 past the sealing element and the support members which thus become free to spring into sealing contact with the pile 15. The support members 50 are pressed against the pile 15 by the element 28 and support it against excessive deformation or rupture under high pressure of grouting fluid, which would cause the seal to break. Only small gaps are left between the support members, as they are closely spaced, so that deformation of the sealing element into the gaps is very small, and does not break the seal. Annular skirts 35 are provided to assist in the sealing contact between the ledge 39 and the guard 26 and between the annular surface 40 and the housing 25. Apertures 37 circumferentially-spaced around the guard enable, in similar fashion to before, grouting cement to pass directly into the annular space 38 once the chamber has been expanded.

It will be appreciated that in the sealing devices shown in FIGS. 3 and 5, the annular longitudinally expandable pressure chamber is shown on the axially inward side of the sealing element. This arrangement has the advantage that by means of the provision of apertures in the protective guard, only one pipe is required. However, by using two pipes, one to operate the sealing device and the other to fill the annular space between a pile and its surrounding leg or can, it would be possible for the chamber to expand when on the axially outward side of the sealing element. In such an arrangement, referring to the sealing device shown in FIG. 3, the sealing element would be moved axially inwardly past the protective guard which would be affixed to the lower end of the housing. Alternatively, referring to the sealing device shown in FIG. 5, the sealing element would be affixed to the annular ledge protruding radially inwardly from the housing, and the guard would be made to slide axially outwardly past the sealing element. In either arrangement, the principle of operation would be the same as for the previously described sealing devices.

Referring to FIG. 7, the sealing element of the sealing devices described is shown, to an enlarged scale, with an internal reinforcement of wire mesh 42 or any other suitable relatively stiff reinforcement material therein. This helps to prevent axial forces acting on the sealing element, once it has made a seal with a pile passing therethrough, from so distorting the inner wall of the sealing element that sealing contact with the pile is broken. Such axial forces can be due to the pressure of grouting cement pumped into the space between the pile and its surrounding leg or piling can, especially when the cement is viscid or where sealing devices are provided at each end of a piling can (one sealing device being inverted relative to the other) and cement is pumped under pressure into the space confined between the two devices.

Referring now to FIGS. 8 and 9, according to an alternative embodiment of the invention, the sealing devices shown use a sealing element in the form of an annular inflatable tube 43. This is located in the space below the annular pressure chamber 27. Support members, of which one is shown at 50, are pivotally connected by generally tangent pivots 52 to the ledge 41 near its inner edge. The support members are disposed between the guard 26 and the element 43, and are arranged close together in a circle.

To achieve a seal, water or a cement and water slurry is pumped into the pressure chamber, which is of similar construction to that shown in FIGS. 5 and 6, causing it to draw the protective guard 26 upwardly and away from the sealing element. The sealing element is then inflated by means of a suitable medium pumped through a pipe 44, thereby causing the element to bulge radially inwardly into sealing contact with the pile and the support members (see FIG. 9). The support members 50 are pressed against the pile 15 by the element 43 and support it against excessive deformation or rupture under high pressure of grouting fluid, which would cause the seal to break. Only small gaps are left between the support members, as they are closely spaced, so that deformation of the seaing element into the gaps is very small, and does not break the seal. Grouting cement can then be pumped into the annular space 38 through a pipe 45 and is prevented by the inflated tube from leaking onto the sea bed.

In a somewhat simplified form (not shown) of FIGS. 8 and 9 the pipe 33 is dispensed with and the pipe 44 is taken to the pressure chamber 27 as well as to the tube 43. A one-way check valve is included in the entry to the tube 43 and is normally held closed by a shear pin. When, by pressure in the chamber 27, the guard has been removed, further pressure builds up in the pipe 44 causing the shear pin to break. The water or slurry then passes through the check valve into the tube and inflates it to effect the seal. Deflation of the tube is subsequently prevented by the check valve.

I claim:

1. A sealing device for sealing an annular space disposed between a tubular supporting leg or a tubular piling can and a pile which passes through either of said tubular supporting legs or said tubular piling can, said tubular supporting leg and tubular piling can supporting a permanent platform disposed above the sea, said sealing device comprising an annular housing which includes an annular protective guard, said annular housing containing an annular sealing element and said annular protective guard being disposed between said annular sealing element and said pile before a seal is made with said pile, actuating means for causing relative axial movement between the annular protective guard and the annular sealing element, said axial movement releasing the annular sealing element whereby the annular sealing element moves into direct sealing contact with the pile and a plurality of support members pivotally connected to the body of the device adjacent the lower end portion of said sealing element, said support members having a length greater than the distance between the annular housing of the sealing device and the tubular piling and lying between the sealing element and the guard before said relative movement is effected and being released by said relative movement to yield into contact with the pile and support the sealing element against excessive deformation or rupture under pressure.

2. A sealing device of claim 1, wherein the annular sealing element has the form of an annular trough which surrounds the pile, at least the radially inner wall of said trough being resilient, said annular protective guard constraining said sealing element before said relative movement and said pile constraining said annular sealing element after said relative movement, said annular sealing element thereby making sealing contact with said pile.

3. The sealing device of claim 2, wherein the annular protective guard forms the innermost wall of said housing, said annular protective guard and said pile defining an annular gap therebetween which communicates with said annular space, the movement of the annular protective guard or the annular sealing element relative to each other releasing the annular sealing element from said housing to form a seal with the pile which extends across said annular gap.

4. The sealing device of claim 2, wherein the annular sealing element, in its relaxed state, is wider at its brim than at its base.

5. The sealing device of claim 4, wherein the annular sealing element is provided with a resilient reinforcing member.

6. The sealing device of claim 1, wherein said actuating means comprises an expandable pressure chamber provided in said housing and means for introducing a suitable fluid medium into said expandable pressure chamber to expand it, said expansion producing said relative movement between the annular protective guard and the annular sealing element.

7. The sealing device of claim 3, wherein the annular protective guard and the outer wall of the housing also form the inner and outer walls, respectively, of the pressure chamber, said pressure chamber being provided with end walls which extend between the annular protective guard and the outer wall of the housing.

8. The sealing device of claim 7, wherein a piston is disposed within the expandable pressure chamber and connected to the annular sealing element, said annular sealing element being in sliding engagement with said annular protective guard so that when a suitable fluid medium is introduced into the expandable pressure chamber, a portion of the annular sealing element is caused to slide past the annular protective guard and into sealing relationship with the pile.

9. The sealing device of claim 7, wherein the base of the housing is an annular ledge which extends radially, inwardly and the annular sealing element is fixed to said annular ledge, said annular protective guard being in sliding engagement with said annular sealing element so that when a suitable fluid medium is introduced into the expandable pressure chamber, the annular protective guard is caused to slide relative to the annular sealing element and the outer wall of the housing and past the annular sealing element, thereby freeing the sealing element into engaging relationship with the pile.

10. The sealing device of claim 3, wherein the expandable pressure chamber is disposed on the axially inward side of the annular sealing element and apertures are provided in the annular protective guard, said apertures being covered by the sealing element before the expandable pressure chamber is expanded, but after said expandable pressure chamber is expanded said sealing element is placed into sealing contact with the pile and fluid communication is established through said apertures between said pressure chamber and said annular gap.

11. The sealing device of claim 10, wherein the apertures are provided circumferentially spaced around the end of the annular protective guard.

12. The sealing device of claim 5, wherein the resilient reinforcing member is an internally disposed member which is made of a relatively stiff material, which, in use, helps to prevent axial forces acting on the annular sealing element from the annular space between the pile and the leg from so distorting the sealing element that the sealing contact between the annular sealing element and the pile passing therethrough is broken.

13. The sealing device of claim 3, wherein the annular sealing element is an annular inflatable tube which, before inflation, is disposed between the innermost wall of the housing and the annular protective guard, and means are provided for inflating the annular sealing element so that after the expandable pressure chamber has been activated to remove the protective guard, the inflated tube extends radially inwardly through the aperture created by the removal of the annular protective guard and forms an engaging seal with the pile.

14. A sealing device for sealing an annular space disposed between a tubular supporting leg and a pile which passes therethrough or between a tubular piling can and a pile which passes therethrough, said tubular supporting leg and tubular piling can functioning as a support for a platform disposed above the sea, said sealing device comprising an annular housing which contains an outer wall, an inner protective guard wall, and upper and lower end walls, said inner protective guard wall extending only a portion of the distance from said upper end wall toward said lower end wall, thereby providing an opening in the lower portion of said housing said inner protective guard wall and said pile defining an annular gap therebetween which communicates with said annular space and with said opening in said housing, an annular ledge disposed in said housing and extending between said outer wall and said inner protective guard wall so as to define an expandable pressure chamber therebetween, said pressure chamber containing an annular resilient sealing element which is disposed adjacent said annular ledge and is in sliding engagement with the inner protective guard wall, actuating means for causing the axial movement of the resilient sealing element with respect to the inner protective guard wall, said actuating means including said expandable pressure chamber and means for introducing a suitable fluid medium into said expandable pressure chamber to expand it, said resilient sealing element, as a result of said axial movement, extending through the opening in said housing and into direct sealing contact with the pile and a plurality of support members pivotally connected to the body of the device adjacent the lower end portion of said sealing element, said support members having a length greater than the distance between the annular housing of the sealing device and the tubular piling and lying between the sealing element and the guard before said relative movement is effected and being released by said relative movement to pivot into contact with the pile and support the sealing element against excessive deformation or rupture under pressure.

15. The sealing device of claim 14, wherein the annular resilient sealing element has a substantially U-shape and is compressed within the expandable pressure chamber, the base of said sealing element being disposed next to said annular ledge and the outer and inner arms of said sealing element being in sliding engagement with the outer wall and the inner protective guard wall of the housing, respectively.

16. The sealing device of claim 15, wherein the inner protective guard wall is provided with a plurality of apertures, said apertures adapted to provide communication between said expandable pressure chamber and said annular gap, said sealing element, as a result of said axial movement, closing said apertures when the pressure chamber is in the non-expanded state and opening said apertures when in the expanded state.

17. The sealing device of claim 16, wherein a shear pin is disposed below said annular ledge, said sheer pin shearing off upon the expansion of the expandable pressure chamber.

18. A sealing device for sealing an annular space between a tubular supporting leg and a pile which passes therethrough or between a tubular piling can and a pile which passes therethrough, said tubular supporting leg and tubular piling can functioning as a support for a platform disposed above the sea, said sealing device comprising an annular housing which contains an outer wall, an inner protective guard wall, and upper and lower end walls, said inner protective guard wall extending only a portion of the distance from said lower end wall, thereby providing an opening in the upper portion of said housing, said inner protective guard wall and said pile defining an annular gap therebetween which communicates with said annular space and with said opening in said housing, an annular wall disposed in said housing and extending between the upper end of said inner protective guard wall and said outer wall of the housing and a fixed annular ledge extending from the outer wall of the housing to a point intermediate to the respective ends of said inner protective guard wall, said annular wall and said fixed annular ledge defining an expandable pressure chamber therebetween, said portion of the housing disposed on the axial outward side of the expandable pressure chamber containing a resilient sealing element which is fixed to the lower end wall of the housing and is in sliding engagement with the inner protective guard wall, activating means for causing axial movement of the inner protective guard wall with respect to the sealing element, said activating means including said expandable pressure chamber and means for introducing a suitable fluid medium into said expandable pressure chamber to expand it, said resilient sealing element, as a result of said axial movement, extending through the opening in said housing and into direct sealing contact with the pile and a plurality of support members pivotally connected to the body of the device adjacent the lower end portion of said sealing element, said support members having a length greater than the distance between the annular housing of the sealing device and the tubular piling and lying between the sealing element and the guard before said relative movement is effected and being released by said relative movement to pivot into contact with the pile and support the sealing element against excessive deformation or rupture under pressure.

19. The sealing device of claim 18, wherein the annular resilient sealing element has a substantially U-shape and is compressed within the expandable pressure chamber, the base of said sealing element being attached to the lower end wall of the housing, and the inner arm of said sealing element being in sliding engagement with the inner protective guard wall.

20. The sealing device of claim 19, wherein the inner protective guard wall is provided with a plurality of apertures, said apertures adapted to provide communication between said expandable pressure chamber and said annular gap, said sealing element, closing said apertures when the pressure chamber is in the non-expanded state and opening said apertures when the expandable pressure chamber is in the expanded state as a result of said axial movement.

21. A sealing device for sealing an annular space disposed between a tubular supporting leg and a pile which passes therethrough or between a tubular piling can and a pile which passes therethrough, said tubular supporting leg and tubular piling can functioning as a support for a platform disposed above the sea, said sealing device comprising an annular housing which contains an outer wall, an inner protective guard wall and upper and lower end walls, said inner protective guard wall extending only a portion of the distance from said lower end wall, thereby providing an opening in the upper portion of said housing, said inner protective guard wall and said pile defining an annular gap therebetween which communicates with said annular space and with said opening into said housing, an annular wall disposed in said housing and extending between the upper end of said inner protective guard wall and said outer wall of the housing and a fixed annular ledge extending from the outer wall of the housing to a point intermediate to the respective ends of said inner protective guard wall, said annular wall and said fixed annular ledge defining an expandable pressure chamber therebetween, said portion of the housing disposed on the axial outward side of the pressure chamber containing an annular, inflatable element which, before inflation, is disposed between the outer wall of the housing and the inner protective guard wall, activating means for causing axial movement of the inner protective guard wall with respect to the annular inflatable element, said activating means including said expandable pressure chamber, means for introducing a suitable fluid medium into said expandable pressure chamber to expand it and means for inflating the annular inflatable element, so that after the expandable pressure chamber has been activated to axially move the protective guard wall, the inflated tubular element extends radially, inwardly through the opening in said housing and into direct sealing contact with the pile and a plurality of support members pivotally connected to the body of the device adjacent the lower end portion of said sealing element, said support members having a length greater than the distance between the annular housing of the sealing device and the tubular piling and lying between the sealing element and the guard before said relative movement is effected and being released by said relative movement to pivot into contact with the pile and support the sealing element against excessive deformation or rupture under pressure.

22. The sealing device of claim 21, wherein means are provided for introducing a suitable fluid medium into the annular space disposed between a tubular supporting leg and a pile which passes therethrough or between a tubular piling can and a pile which passes therethrough.

* * * * *